United States Patent [19]

Tanaka et al.

[11] Patent Number: 4,721,070

[45] Date of Patent: Jan. 26, 1988

[54] PORTABLE ENGINE-OPERATED WORKING MACHINE

[75] Inventors: Yoshio Tanaka; Tadahiro Yaguchi, both of Saitama, Japan

[73] Assignee: Honda Giken Kogyo Kabushiki Kaisha, Tokyo, Japan

[21] Appl. No.: 39,836

[22] Filed: Apr. 17, 1987

Related U.S. Application Data

[63] Continuation of Ser. No. 785,684, Oct. 9, 1985, abandoned.

[30] Foreign Application Priority Data

Oct. 9, 1984 [JP] Japan ..... 59-152606[U]

[51] Int. Cl.[4] ..... F02B 63/04

[52] U.S. Cl. ..... 123/2; 123/198 E; 290/1 B

[58] Field of Search ..... 123/2, 195 C, 198 E; 290/1 R, 1 B, 1 A

[56] References Cited

U.S. PATENT DOCUMENTS

| | | | |
|---|---|---|---|
| D. 201,327 | 6/1965 | Hori et al. | D77/1 |
| D. 205,975 | 10/1966 | Sato | D77/1 |
| D. 275,946 | 10/1984 | Ekuan | D13/1 |
| D. 276,515 | 11/1984 | Yaguchi | D13/1 |
| 1,380,123 | 5/1921 | Sullivan | 290/1 A |
| 3,529,752 | 7/1966 | Honda | 290/1 A |
| 4,595,841 | 6/1986 | Yaguchi | 290/1 A |
| 4,608,946 | 9/1986 | Tanaka et al. | 123/2 |
| 4,622,923 | 11/1986 | Nishimura et al. | 290/1 B |
| 4,677,940 | 7/1987 | Bracht et al. | 290/1 A |

FOREIGN PATENT DOCUMENTS

| | | | |
|---|---|---|---|
| 53-8405 | 1/1978 | Japan | 123/2 |
| 53-3302 | 1/1978 | Japan . | |
| 54-166524 | 11/1979 | Japan . | |
| 58-197416 | 11/1983 | Japan . | |
| 58-197417 | 11/1983 | Japan . | |
| 58-197418 | 11/1983 | Japan . | |
| 59-170596 | 9/1984 | Japan . | |
| 2141782 | 1/1985 | United Kingdom | 290/1 A |

*Primary Examiner*—William A. Cuchlinski, Jr.
*Attorney, Agent, or Firm*—Armstrong, Nikaido, Marmelstein & Kubovcik

[57] ABSTRACT

A portable engine-operated working machine includes a pair of frame members each having at least a horizontal top bar and a pair of vertical bars extending downwardly from the opposite ends of the horizontal top bar, a bottom cover interconnecting the lower ends of the frame members, a carrying handle interconnecting the horizontal top bars of the frame members, an engine supported on the bottom cover, and a working unit supported on the bottom cover adjacent to the engine.

7 Claims, 9 Drawing Figures

10
10a
3b
3f
3
3a
3k
3e
3i
3n
3j
3l
7b
3c
3d
3h
3h
13
13a
13b
13c
6a
6
6b
11
5d
7f
7d
7
7a
7e
5e
5
4d
4
4c
4f
4a
12
7b
7d
2f
2g
2b
2a
5c
5a
5b
2e
14
2h
2n
2l
4e
2d
4b
4f
2h
2c
2
14c
14d
8e
8b
8f
8c
8
8a
8d
9a
9b
9

PORTABLE ENGINE-OPERATED WORKING MACHINE

This application is a continuation of application Ser. No. 785,684, filed Oct. 9, 1985, now abandoned.

BACKGROUND OF THE INVENTION

The present invention relates to a portable engine-operated working machine such as a portable engine-operated electric generator.

The frame structure for portable engine-operated working machines is disclosed in Japanese Laid-Open Utility Model Publication No. 53-3302. The disclosed frame structure includes a main frame shaped as a rectangular thin continous frame and two support members disposed in spaced relation on the slender bottom of the main frame. The engine-operated working unit is fixedly positioned on the support members. Two front and rear cover halves are coupled to the main frame on its opposite sides.

In the above conventional design, a fuel tank is attached by a bracket secured to the inner surfaces of laterally spaced vertical bars of the main frame. Since the main frame is in the form of a continuous loop, it is necessary to insert the fuel tank longitudinally and fasten the flange around the fuel tank to the brackets. In view of the low structural accuracy of the tank and the low attachment accuracy of the brackets, the fuel tank cannot easily and accurately be installed. Since the bracket is attached transversely of the main frame and the frame is covered by the two front and rear cover halves, the fuel tank is required to be fastened to the bracket to facilitate detachment of the cover halves. Therefore, the number of steps required to assemble the components together is increased. Other fuel tanks of general design also cannot be attached with ease. Where the engineoperated electric generator is portable, it has a carrying handle on top thereof. For assembly, after the engine and the generator have been assembled in position, the bracket is attached, and then the fuel tank is placed and fastened thereto, followed by attachment of the carrying handle over the fuel tank. Consequently, the assembling process involves many steps, and has a poor efficiency.

The present invention has been made in an effort to solve the above problems.

SUMMARY OF THE INVENTION

It is an object of the present invention to provide an engine-operated working machine which is simple, rigid and sturdy in construction, has an engine and a working unit that are reliably supported, can be carried in good balance, and has a sound-insulating cover which can easily be attached and detached for better maintenance.

Another object of the present invention is to provide a fuel tank support structure for portable engineoperated working machines which can be assembled with utmost ease, is made up of a smaller number of parts, and can support a fuel tank stably and reliably.

According to the present invention, there is provided a portable engine-operated working machine which includes a pair of transverse frame members each having at least a transverse horizontal top bar and a pair of vertical bars extending downwardly from the opposite ends of the horizontal top bar, a bottom cover interconnecting the lower ends of the frame members, a carrying handle interconnecting the transverse horizontal top bars of the frame members, an engine supported on the bottom cover, and a working unit supported on the bottom cover adjacent to the engine.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

The present invention will be illustrated as being incorporated in a portable engine-operated electric generator. However, the invention may be applied to other engine-operated working machines.

Figure 1:
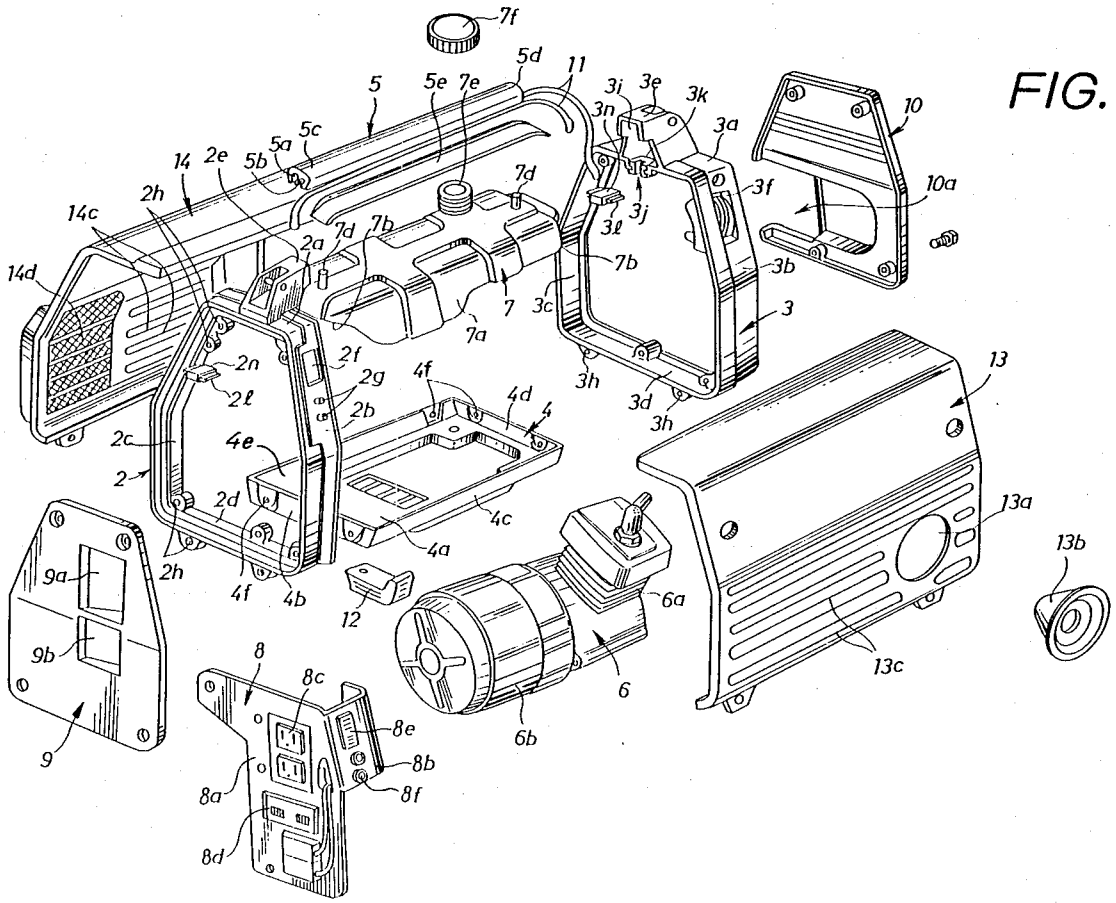
FIG. 1 is an exploded perspective view of an engine-operated working machine according to an embodiment of the present invention.

As shown in FIG. 1, the portable engine-operated generator has two symmetrically shaped frame members 2, 3 each having a centrally open, continuous closed-loop configuration. The frame members 2, 3 have transverse top bars 2*a*, 3*a*, two vertical bars 2*b*, 2*c*, 3*b*, 3*c* extending downwardly from the opposite ends of the top bars 2*a*, 3*a*, bottom bars 2*d*, 3*d* connecting the lower ends of the vertical bars 2*b*, 2*c*, 3*b*, 3*c*, and support projections 2*e*, 3*e* disposed centrally on the top bars 2*a*, 3*a* and having inwardly opening recesses 2*i*, 3*i*, respectively. The vertical bars 2*b*, 2*c*, 3*b*, 3*c* have inclined upper portions which jointly assume respective trapezoidal shapes with narrower upper ends and wider lower ends. The vertical bars 2*b*, 3*b* have on their inclined upper portions transverse through-openings or windows 2*f*, 3*f*, and switch attachment points 2*g*. The frame members 2, 3 also have attachment bosses 2*h*, 3*h*. The frame members 2, 3 are integrally formed of an aluminum alloy by die casting, and hence are lightweight. Since the frame members 2, 3 are of a closed-loop shape, they are highly rigid and sturdy in construction. The frame members 2, 3 may however be molded of synthetic resin such as nylon or polypropylene.

A tray-shaped bottom cover 4 includes a bottom 4*a* surrounded by four peripheral walls 4*b* through 4*e* which are bent, raised, or drawn, the bottom 4*a* and the peripheral walls 4*b* having attachment points 4*f*. The bottom cover 4 is formed by pressing a steel sheet.

A carrying handle 5 has downwardly opening grooves 5*a*, 5*b* extending the entire length thereof. The carrying handle 5 is formed of an extruded or drawn aluminum alloy. The carrying handle 5 has a lower cover 5e extending therebelow in covering relation to the grooves 5a, 5b and having substantially the same length as that of the carrying handle 5.

For assembly, the walls 4b, 4d of the bottom cover 4 are positioned inwardly of the bottom bars 2d, 3d of the frame members 2, 3, and fastened to the bottom bars 2d, 3d by means of screws extending through the attachment bosses 2h, 3h threaded into the attachment points 4f. At the same time, the opposite ends 5c, 5d of the carrying handle 5 and the opposite ends of the lower cover 5e are inserted in the recesses 2i, 3i of the support projections 2e, 3e thereby to install the carrying handle 5 in the longitudinal direction between the upper ends of the frame members 2, 3.

Figure 3:
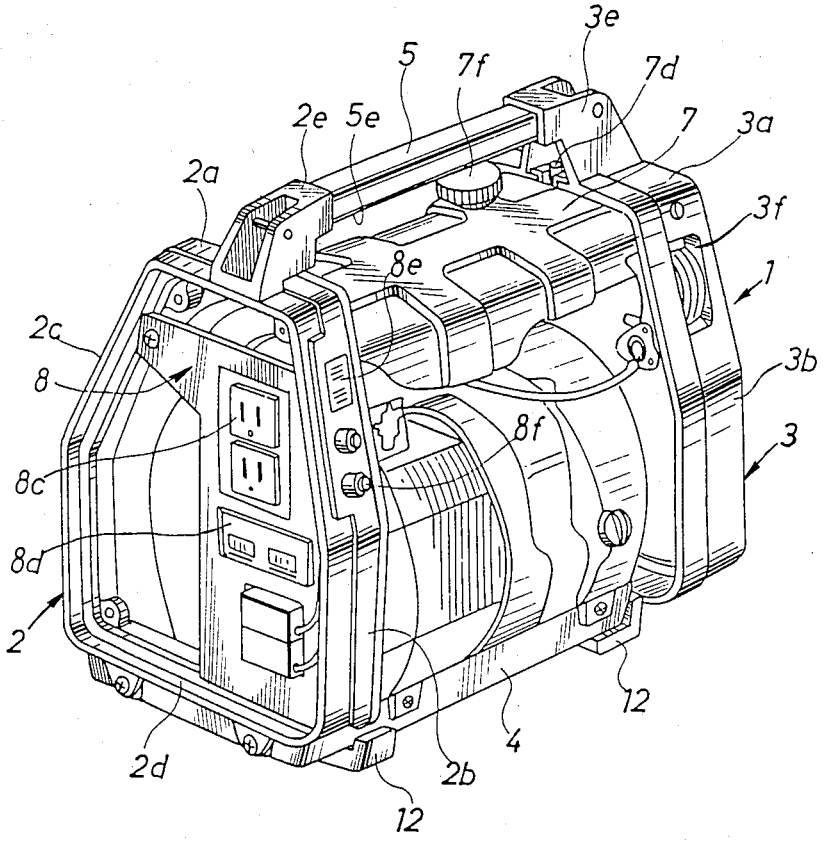
FIG. 3 is a perspective view the engine-operated working machine with a fuel tank attached in position.
Figure 4:
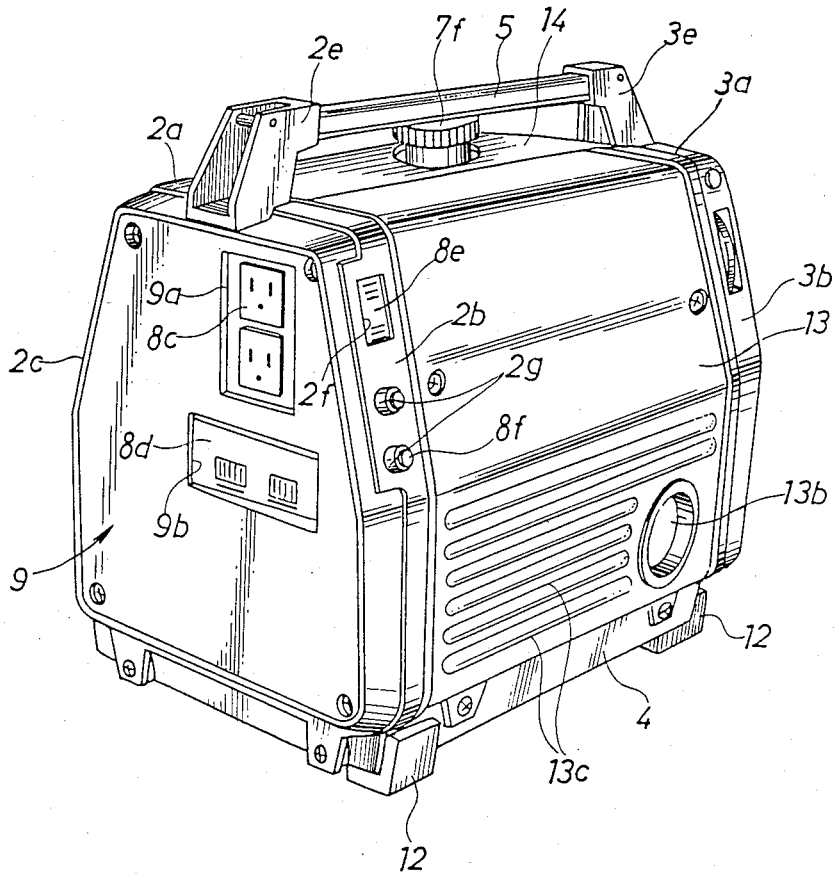
FIG. 4 is a perspective view of the engine-operated working machine.

The frame members 2, 3, the bottom cover 4, and the carrying handle 5 are thus assembled into a frame 1 as shown in FIG. 3. The frame members 2, 3 are coupled together by the bottom cover 4 and the carrying handle 5.

A generator assembly 6 is disposed on the bottom cover 4 of the frame 1. The generator assembly 6 includes an engine 6a composed of an engine proper and accessories therof and an electric generator 6b coupled to the crankcase of the engine 6a. The generator assembly 6 is mounted on the bottom 4a of the bottom cover 4, with the engine 6a and the generator 6b being supported by some of the attachment points 4f and some of the attachment bosses 2h, 3h of the frame members 2, 3.

When the frame 1 is assembled as described above, a fuel tank 7 is simultaneously attached.

Figure 2:
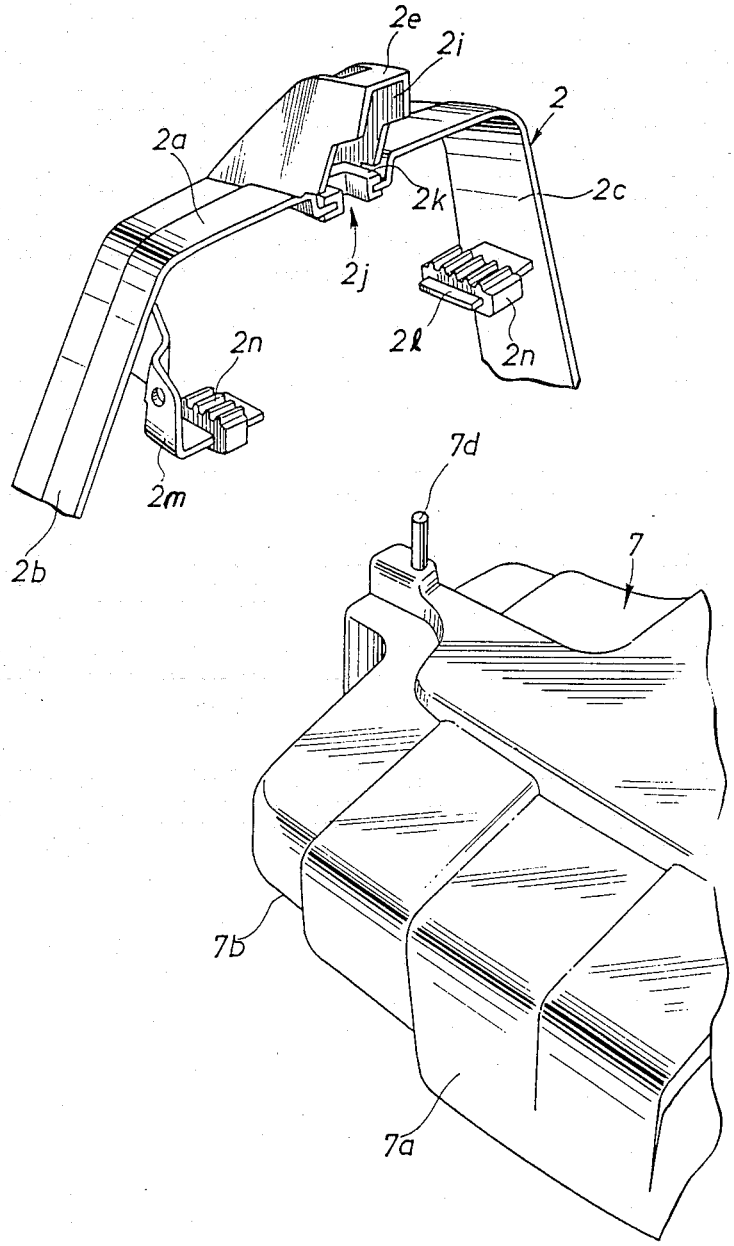
FIG. 2 is a fragmentary perspective view of a fuel tank support structure.
Figure 7:
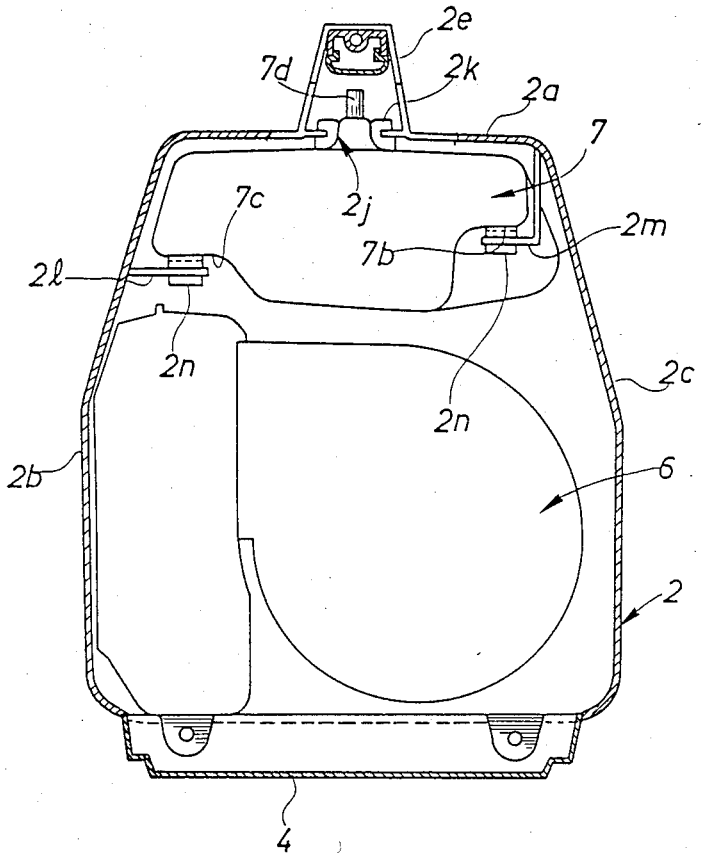
FIG. 7 is a schematic vertical sectional side elevational view of the engine-operated working machine.

As shown in FIGS. 1, 2 and 7, the fuel tank 7 has engagement steps 7b, 7c spaced transversely from each other at each of the longitudinal ends of a tank body 7a, the engagement steps 7b, 7c being higher than the bottom of the tank body 7a. Positioning pins 7d in the form of breather pipes are mounted on the ends of the tank body 7a at transversely central positions. The fuel tank 7 has a fuel inlet port 7e laterally displaced on its upper surface and openably closed by a cap 7f. The fuel tank 7 is made of synthetic resin in the illustrated embodiment.

The top and bottom bars 2a, 3a below the support projections 2e, 3e have positioning recesses 2j, 3j defined centrally and opening inwardly, with vibration dampers 2k, 3k of rubber mounted in the positioning recesses 2j, 3j, respectively. The vertical bars 2b, 2c, 3b, 3c have tank brackets on the confronting inner surfaces thereof. As shown in FIG. 2, the brackets on the vertical bars 2b, 2c are denoted at 2l, 2m spaced from each other. One of the brackets on the other vertical bars 3b, 3c is denoted at 3l in FIG. 1, but the other bracket corresponding to the bracket 2m is concealed from view in FIG. 1. Vibration dampers 2n, 3n of rubber are mounted respectively on these brackets. The brackets are formed integrally with the frame members 2, 3 at the time they are formed by die casting.

Figure 5:
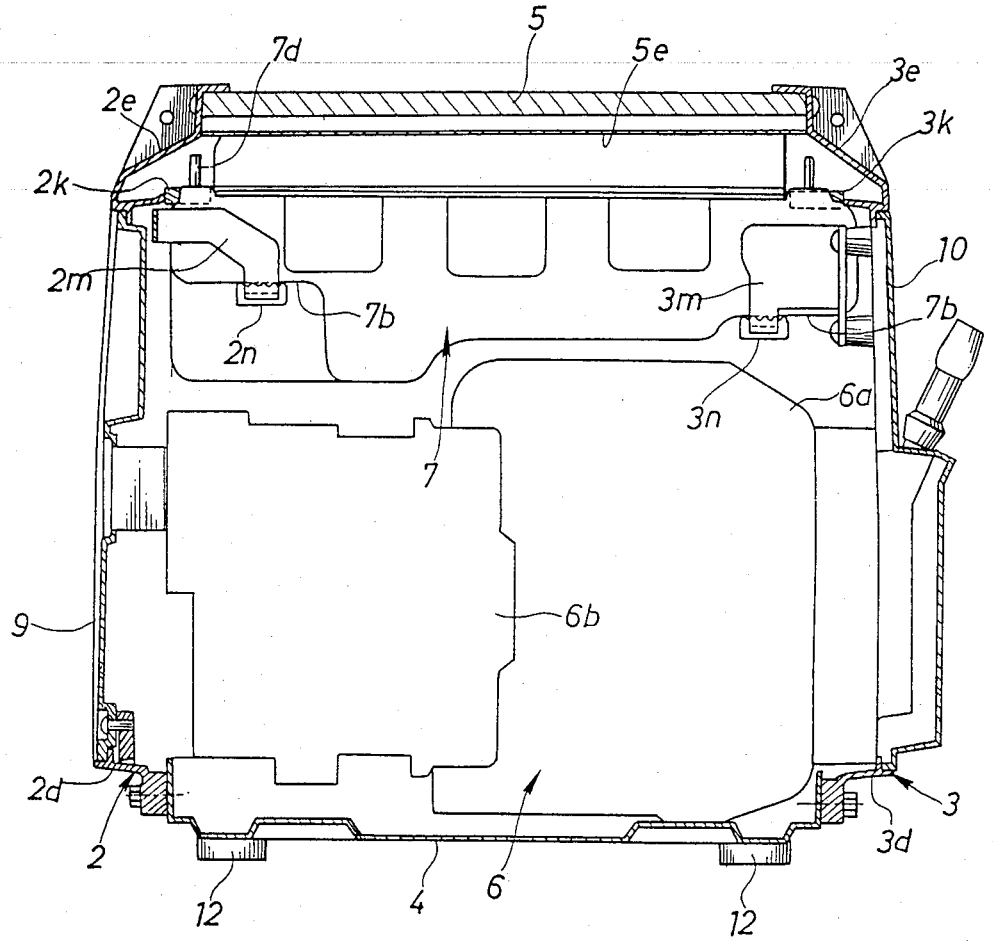
FIG. 5 is a schematic vertical sectional front elevational view of the engine-operated working machine.
Figure 6:
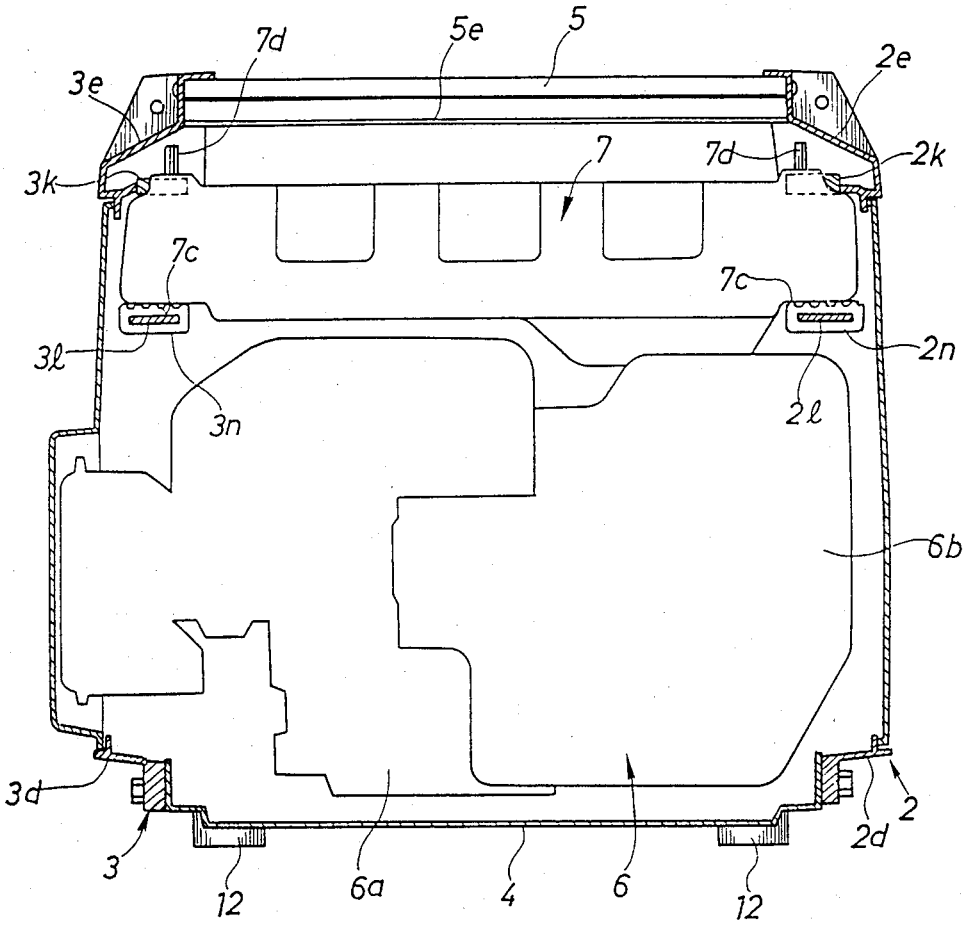
FIG. 6 is a schematic vertical sectional rear elevational view of the engine-operated working machine.

For assembly, the opposite ends of the fuel tank 7 are positioned between the top bars 2a, 3a of the frame members 2, 3. The positioning pins 7d, 7d of the fuel tank 7 are inserted respectively in the positioning recesses 2j, 3j. Since the positioning pins 7d, 7d are located outwardly of the steps 7b, 7c, the positioning pins 7d, 7d are positioned by the recesses 2j, 3j first in the transverse direction. Then, the frame members 2, 3 are moved toward each other to place the steps 7b, 7c onto the brackets 2l, 3l, 2m, so as to be supported on the rubber dampers 2n, 3n. The ends 5c, 5d of the carrying handle 5 have already been fitted in the recesses 2i, 3i, respectively, and the bottom bars 2d, 3d of the frame members 2, 3 have been held against the walls 4b, 4d of the bottom cover 4, so that the bottom cover 4 and the carrying handle 5 have been coupled to the frame members 2, 3. The frame members 2, 3 are therefore tied together highly rigidly at their upper and lower ends. The fuel tank 7 disposed between the top bars 2a, 3a of the frame members 2, 3 is supported by the brackets 2l, 2m, 3l of the frame members 2, 3. Since the frame members 2, 3 are rigidly coupled together, the fuel tank 7 is stably supported on the frame 1 at the time the frame 1 is assembled. The positioning and supporting relationship between the frame 1 and the fuel tank 7 is illustrated in FIGS. 5 through 7.

The generator of the illustrated embodiment is of the soundproof type. A control panel 8 is attached to the frame member 2 and has a base board 8a facing laterally of the frame member 2, and a side board 8b extending laterally from an upper portion of the base board 8a. The baseboard 8a supports thereon AC/DC outlets 8c and AC/DC output terminals 8d, and the side board 8b supports thereon frequency and output voltage indicators 8e and control members such as switches 8f. The control panel 8 is fixed by the attachment bosses 2h to the frame member 2 so that the frequency and output voltage indicators 8e are exposed through the window 2f and the switches 8f are exposed through the switch attachment points 2g. Thereafter, a lefthand cover 9 is fastened to the frame member 2 to cover the outer lateral side thereof. The cover 9 has windows 9a, 9b through which the AC/DC outlets 8c and the AC/DC output terminals 8d are exposed.

The outer lateral side of the frame member 3 is covered with a righthand cover 10. The cover 10 has an open projection 10a through which a recoil starter is exposed.

Breather tubes 11 are housed respectively in the grooves 5a, 5b of the carrying handle 5 and retained therein by the lower cover 5e. Legs 12 as of rubber are attached to the respective four corners of the bottom cover 4.

Front and rear covers 13, 14 are also attached to the frame members 2, 3. The front cover 13 has an opening 13a near one of its corners for allowing the user to supply oil to the engine 6a, the opening 13a being normally closed by a cap 13b as of rubber. The front and rear covers 13, 14 have ventilation slits 13c, 14c for cooling the interior of the machine and radiating heat. The rear cover 14 also has a mesh air vent 14d.

The portable engine-operated generator is rendered soundproof by being covered with the covers 9, 10, 13, 14.

FIGS. 5 and 6 show in front and rear elevations the manner in which the fuel tank 7 is supported, and FIG. 7 illustrates in side elevation the manner in which the fuel tank 7 is supported and positioned.

Figure 8:
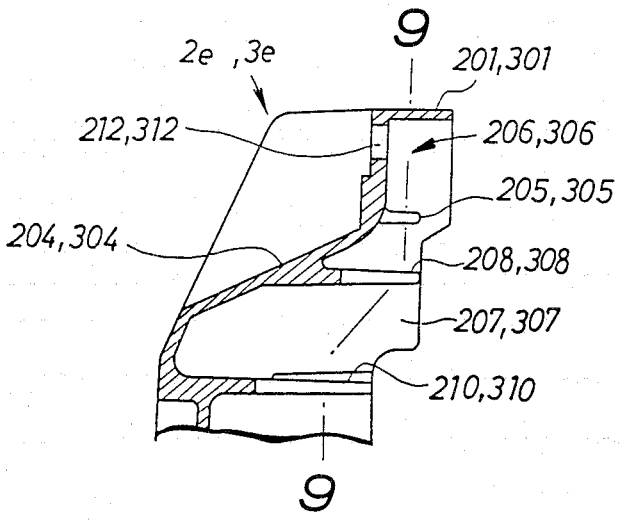
FIG. 8 is a vertical sectional front elevational view of a support projection.
Figure 9:
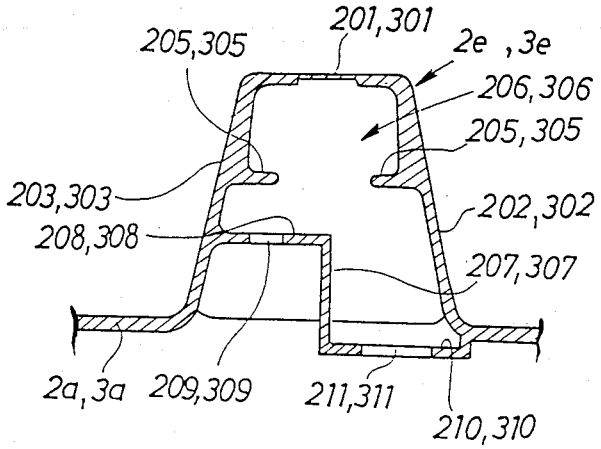
FIG. 9 is a cross-sectional view taken along line 9—9 of FIG. 8.

FIGS. 8 and 9 are illustrative in detail of the support projections 2e, 3e on the frame members 2, 3. As shown in FIG. 9, the support projection 2e, 3e is in the form of a box opening inwardly and comprises a top wall 201, 301, side walls 202, 203, 302, 303, and a rear wall 204, 304 of a stepped configuration facing obliquely outwardly (FIG. 8). The side walls 202, 203, 302, 303 have ledges 205, 305 extending in confronting relation to each other and to the top wall 201, 301 to define a handle insertion hole 206, 306 above the ledges 205, 305. The support projection 2e, 3e also has a Z-shaped partition 207, 307 below the ledges 205, 305. The partition 207, 307 includes an upper member 208, 308 having a hole 209, 309 for passage of the breather tubes therethrough, and a lower member 209, 309 having a vent hole 211, 311. The rear wall 204, 304 has an upper vent hole 212, 312 providing communication between the handle insertion hole 206, 306 and the exterior. With the support projections *2e, 3e* thus constructed, heated air in the frame 1 rises and is discharged out of the frame 1 through the vent holes 211, 311 and the holes 212, 312 in the support pojections 2, 3. Therefore, cooling air can effectively flow upwardly through the frame 1 and the support projections 2, 3 for increased cooling efficiency.

With the arrangement of the present invention, the frame is composed of a pair of centrally open transverse frame members, a bottom cover interconnecting the bottom bars of the frame members, and a carrying handle interconnecting the top bars of the frame members. The engine and the generator supported on the bottom cover are suspended by the four vertical bars of the frame members on the four corners of the bottom cover when the engine-operated generator is carried around. Therefore, the engine and the generator can be supported in stable balance. Since the engine and the generator are supported at the four corners of the frame and on the plate-shaped support or bottom cover, it is not necessary to be highly concerned with the balancing of the engine and the generator in design. The engine and the generator can therefore be designed and structured primarily in view of their functions for better functional capability. The frame is rigid at its far corners and is rugged and sturdy as a whole so as to provide sufficient and reliable support for the engine and the generator which may be increased in weight for added functions. The frame is simple, and can easily be assembled together with the engine and the generator. The frame can be mass-proudced at a reduced cost. When the frame is assembled, the opposite ends of the fuel tank are positioned and supported on the brackets on the frame which are located below the support projections for the carrying handle. Therefore, the fuel tank can be attached at the same time that the frame is assembled. The fuel tank can thus be attached simply by placing the ends thereof in engagement with the brackets when the frame is put together. The structure for supporting the fuel tank is simple, made up of a small number of parts, and the process of attaching the fuel tank is quite easy to perform. Inasmuch as the fuel tank is supported between the frame members which are firmly coupled by the carrying handle and the bottom cover, no fastening or coupling means is required, but the fuel tank can be as securely and reliably supported as if fastening or coupling means were employed. The fuel tank is protected by the frame members since the fuel tank is supported between the frame members. Where the frame members are formed by die casting, the brackets can be formed integrally with the frame members, so that the frame members can easily be manufactured and assembled. In addition, the covers attached to the four sides of the frame can easily be detached, and the machine can conveniently be serviced for maintenance since only the cover which gives access to the desired parts may need be detached. The indicators, switches, outlets, and other accessory parts are mounted on the control panel attached to the attachment bosses integral with the rigid frame member. The panel is therefore protected by the frame member against damage. The control panel can easily be attached because it is secured to the corner-forming frame member. Any wires connected to the indicators, switches, outlets, and other accessory parts on the control panel can be lumped together behind the frame member and hence can easily be installed.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

What is claimed is:

1. A hand carriable portable engineoperated working machine comprising:

an engine and a working machine coupled to said engine and driven thereby;

a pair of transverse frame members for supporting for carrying said engine and said working machine attached to and driven said engine, each member of said pair of transverse members having at least a transverse horizontal top bar and a pair of vertical bars integral with and extending downwardly from the opposite ends of said transverse horizontal top bar;

a bottom member interconnecting the lower ends of said frame members;

said engine and said working machine being mounted on said bottom member; and a carrying handle for lifting, through said transverse frame members, and for carrying said engine and said working machine mounted on said bottom member, said handle extending in the longitudinal direction and being connected at its opposite ends to said transverse top bars of said frame members.

2. A portable engine-operated working machine according to claim 1, including front and rear covers for covering front and rear open spaces between said frame members, and lateral covers for covering lateral open spaces in said frame members.

3. A portable engine-operated working machine according to claim 1, including a fuel tank, said frame members each having brackets positioned below said transverse horizontal top bars for supporting said fuel tank, wherein said fuel tank has opposite ends supported by said brackets between said transverse horizontal top bars of said frame members.

4. A portable engine-operated working machine according to claim 3, wherein said brackets include vibration absorbing means.

5. A portable engine-operated working machine according to claim 1, wherein at least one of said frame members has integral attachment points and a control panel supporting exposed indicators and control members attached to said frame member attachment points.

6. A portable engine-operated working machine according to claim 1, wherein each of said transverse frame members including a support projection coupled to said transverse horizontal top bar, and wherein said carrying handle is coupled to said support projections.

7. A portable engine-operated working machine according to claim 6, wherein each of said support projections includes means for engaging said handle.

* * * * *